US006452774B1

(12) United States Patent
Hsu

(10) Patent No.: US 6,452,774 B1
(45) Date of Patent: Sep. 17, 2002

(54) ELECTROSTATIC RESISTANT HAND RING

(75) Inventor: Shih-Ming Hsu, Taipei (TW)

(73) Assignee: Compound, Cable Assembly & Design Corp., Taipei (TW)

( * ) Notice: Subject to any disclaimer, the term of this patent is extended or adjusted under 35 U.S.C. 154(b) by 0 days.

(21) Appl. No.: 09/324,151

(22) Filed: Jun. 2, 1999

(51) Int. Cl.[7] ..... H05F 3/02; H01H 47/00
(52) U.S. Cl. ..... 361/220; 361/212
(58) Field of Search ..... 361/212, 220; 439/92, 37, 799; 24/265 BC

(56) References Cited

U.S. PATENT DOCUMENTS 4,398,277 A 8/1983 Christiansen et al.
4,577,256 A 3/1986 Breidegam
4,639,825 A 1/1987 Breidegam
4,662,695 A 5/1987 Gordon et al.
4,782,425 A 11/1988 Breidegam
4,813,459 A 3/1989 Breidegam
4,816,964 A * 3/1989 Weiss ..... 361/220
4,845,585 A 7/1989 Weiss
4,998,178 A 3/1991 Weiss
5,004,425 A * 4/1991 Hee ..... 439/37
5,018,044 A 5/1991 Weiss
5,036,423 A 7/1991 Williams
5,067,906 A 11/1991 Woodgate
5,184,274 A * 2/1993 Weiss ..... 361/220
5,548,469 A 8/1996 Adams
5,568,351 A 10/1996 West et al.
5,677,822 A 10/1997 Cohen et al.
5,686,897 A * 11/1997 Loh ..... 340/649
5,754,389 A 5/1998 Hsu

FOREIGN PATENT DOCUMENTS

GB 2 243 034 A 10/1991

* cited by examiner

*Primary Examiner*—Kim Huynh
(74) *Attorney, Agent, or Firm*—Finnegan, Henderson Farabow Garrett & Dunner, L.L.P.

(57) ABSTRACT

A structure of an electrostatic resistant hand ring. A buckling component is installed on a conductive belt, the buckling component is formed by an upper cover and a lower cover. One side of the upper cover is connected to the lower cover. While the opposite side is installed with a buckling ring, another two sides are installed with a first hanging ring and a second hanging ring, respectively. A pillar is installed in a proper place within the upper cover, and another pillar is installed in a proper place within the lower cover. The two pillars are not at the same position. A buckling portion is installed in a lower cover in a place with respect to the buckling ring. The conductive belt passes through the first and second hanging rings, then passes around the pin within the body of the conductive belt, and then enters into the buckling component to be connected by the upper cover and the lower cover so as to be clamped by the two pillars and is therefore fixed. The distal end of the conductive belt is hidden within the buckling component, and thus it is not fixed by seaming and the length of the conductive belt can be adjusted as desired.

8 Claims, 4 Drawing Sheets

ELECTROSTATIC RESISTANT HAND RING

FIELD OF THE INVENTION

The present invention relates to a structure of an electrostatic resistant hand ring, and especially to an electrostatic resistant hand ring, wherein the distal end of a conductive belt is not seamed, while the length thereof may be adjustable as desired.

BACKGROUND OF THE INVENTION

A electrostatic resistant hand ring is an elastic fabric forming by metal and is covered on a wrist. By contacting with a human body, the electrostatic will transfer to the ground through a bank of wires. Therefore, in electronic and chemical industries, components will not be destroyed by electrostatic.

A prior art electrostatic resistant hand ring 10 is shown in FIG. 1, which is formed by a body 11, a conductive belt 12, and a buckling component 13. The body 11 is formed by a cover 111 and a conductive plate 112 which are combined together by a convex button 113 and a rivet 114. The convex button 113 protrudes outside the cover 111 for connecting with conducting wires (not shown) so as to prevent the electrostatic. The conductive belt 12 is located between the cover 111 and the conductive plate 112, and is combined to the convex button 113 by the rivet 114 so as to form as an electric loop with the conductive plate 112. Another end of the conductive belt 12 passes through two slots 131 installed in the buckling component 13, and then it further enters into the body 11 and pass through a slot 1121 on one side of the conductive plate 112, finally, after the conductive belt passes through the two slots 131 of the buckling component 13, it is seamed (as shown in the seam line 121). Therefore, the conductive belt 12 is formed as a closed ring portion with the body 11. By adjusting the position of the buckling component 13 in the conductive belt 12, the peripheral length of the electrostatic resistant hand ring 10 on the wrist can be adjusted according to the size of the user's wrist.

SUMMARY OF THE INVENTION

Accordingly, the object of the present invention is to provide a structure of an electrostatic resistant hand ring. A buckling component is installed on a conductive belt, the buckling component is formed by an upper cover and a lower cover. One side of the upper cover is connected to the lower cover. While the opposite side is installed with a buckling ring, another two sides are installed with a first hanging ring and a second hanging ring, respectively. A pillar is installed in a proper place within the upper cover, and another pillar is installed in a proper place within the lower cover. The two pillars are not at the same position. A buckling portion is installed in a lower cover in a place with respect to the buckling ring. The conductive belt passes through the first and second hanging rings, then passes around the pin within the body of the conductive belt, and then enters into the buckling component to be connected by the upper cover and the lower cover so as to be clamped by the two pillars and is therefore fixed. The distal end of the conductive belt is hidden within the buckling component, and thus it is not fixed by seaming and the length of the conductive belt can be adjusted as desired.

From the aforementioned description, it is appreciated that another end of the conductive belt is pressed and fixed by the pressing plate installed on the body. Two ends of the conductive belts can be separated with the body, and it can be updated according to required length.

Another object of the present invention is to provide a conductive plate below the body, one end of which is bent upwards with an angle of 180 degrees. As the pressing plate is pressed, the clamping strip thereof is exactly contact with this bent portion even the metal web within the conductive belt is formed as a loop with the conductive plate. Therefore, the convex button and the rivet for forming the body will not pass through the conductive belt. Thus, the conductive belt can be separated with the body.

The various objects and advantages of the present invention will be more readily understood from the following detailed description when read in conjunction with the appended drawing.

DETAILED DESCRIPTION OF THE PREFERRED EMBODIMENTS

Figure 1:
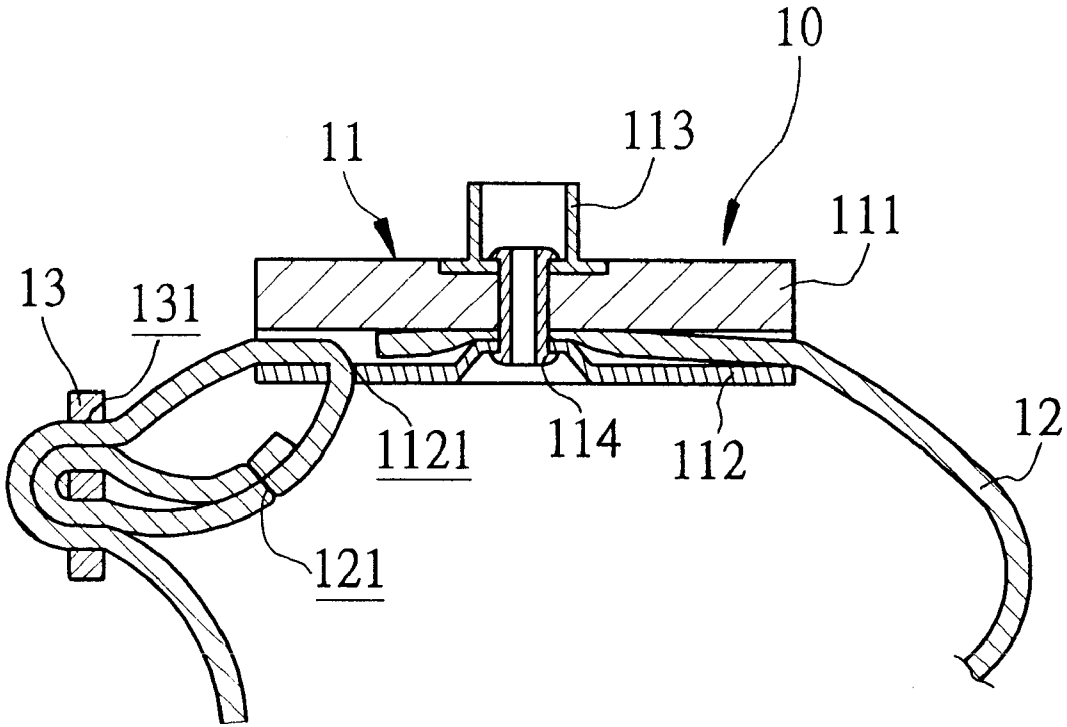
FIG. 1 PRIOR ART
FIG. 1 is a cross sectional view of a prior art electrostatic resistant hand ring.
Figure 2:
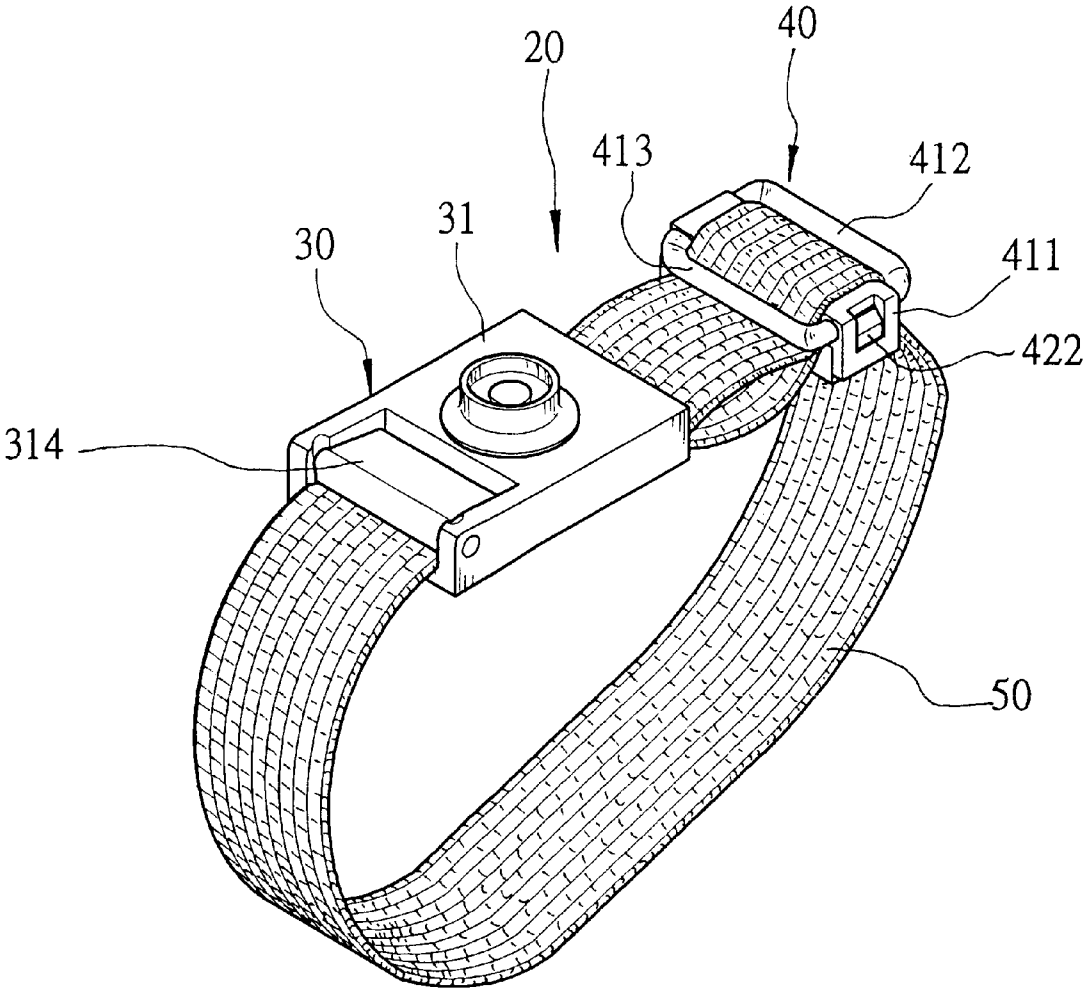
FIG. 2 is a perspective view of the present invention.
Figure 3:
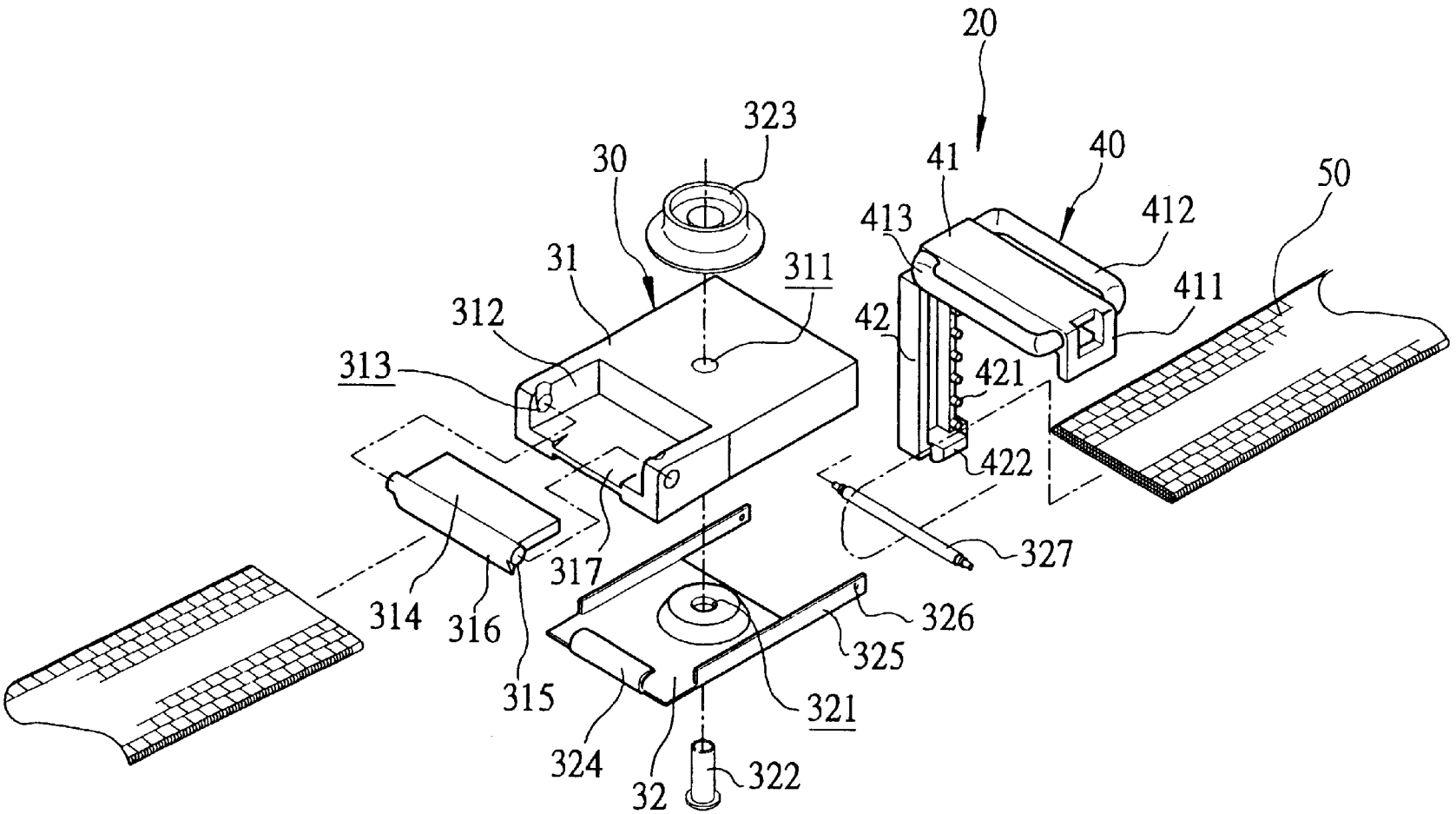
FIG. 3 is an exploded perspective view of FIG. 1.
Figure 4:
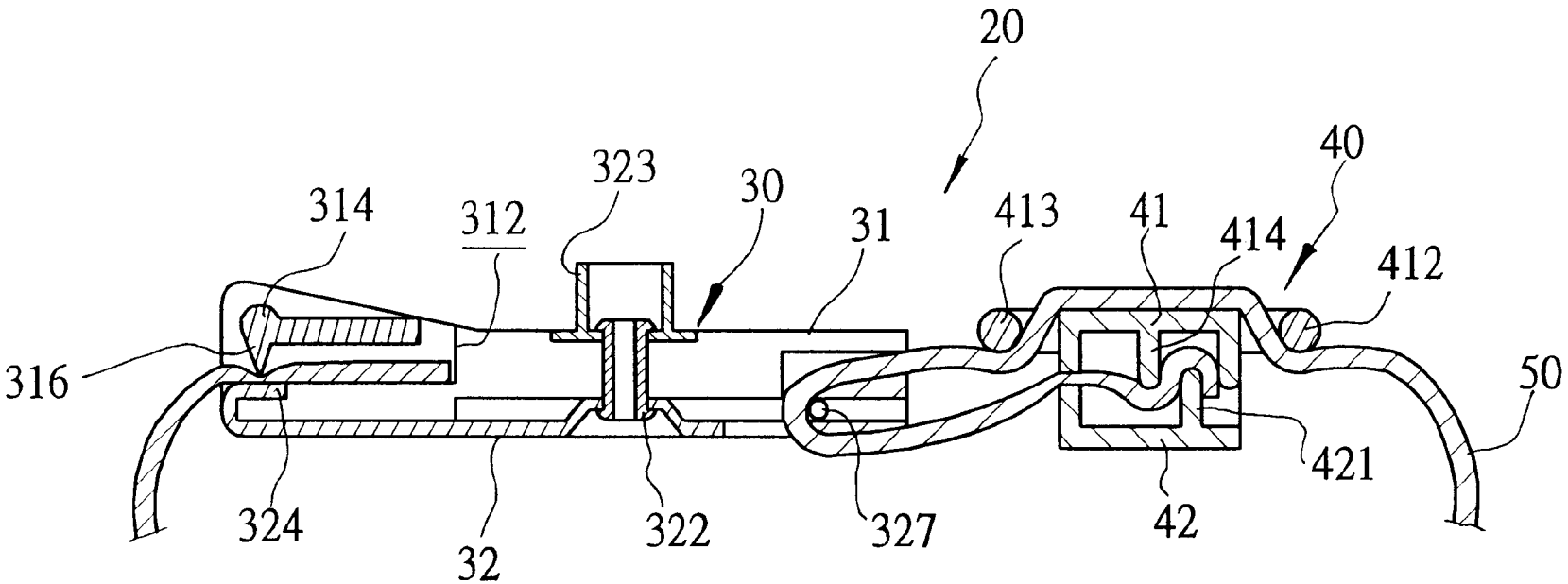
FIG. 4 is a lateral cross sectional view of FIG. 1.

With reference now to FIGS. 2 and 3, the perspective view and exploded view of the present invention are illustrated. The electrostatic resistant hand ring of the present invention has the following components and structure.

The body 30 includes a cover 31 and a conductive plate 32.

The cover 31 is installed with a hole 311 on a proper position and a cover portion 312 is formed on one side thereof. One side of the cover portion 312 is installed with respective axial hole 313.

The cover portion 312 serves to assemble with a pressing plate 314 so to close the concave portion 312. An axial rod 315 is formed on the two sides of the pressing plate 314. The lower portion thereof is formed with a clamping strip 316. The pressing plate 314 is assembled within the axial hole 313 installed in the concave portion 312. Besides, the concave portion 312 is installed with a thin edge 317.

The conductive plate 32 is installed with a hole 321 with respect to the cover 31. Thereby, a rivet 322 can be inserted into a buckling hole 323. Thus, the cover 31 and the conductive plate 32 are combined integrally. One side of the conductive plate 32 bends upwards with an angle of 180 degrees and to be formed with an embedding piece 324 which embeds into the thin edge 317 installed on the concave portion 312 so that the conductive plate 32 is fixed the lower portion of the cover 31. While two sides of the conductive plate 32 are installed with enclosing plate 325, the distal end of the enclosing plate 325 is installed with respective hole 326 for being assembled with a pin 327.

A buckling component 40 is formed by an upper cover 41 and a lower cover 42. One side of the upper cover 41 is connected with the lower cover 42. One buckling ring 411 is installed on one side thereof, while two sides thereof are installed with respective first hanging ring 412 and second hanging ring 413. A pillar 414 is formed at a proper place within the upper cover 41. A pillar 421 is formed at a proper place within the lower cover 42, which is in different position with respect to the location of the pillar 414. A buckling portion 422 is formed on the lower cover in a place with respect to the buckling ring 411.

During assembling, the pin 327 is inserted into the holes 326 on the two enclosing plates 325 of the conductive plate 32 so that the embedding piece 324 of the conductive plate 32 is embedded into the thin edge 317 of the concave portion 312 of the body 30. Next, a rivet 322 is inserted into the holes 321 and 311 with respect to the covers on the conductive plate 32 so as to form a complete body 30. The pressing plate 314 is fixed by inserting the axial rod 315 to the axial hole 313 of the concave portion 312.

One end of the conductive belt 50 passes through the first and second hanging rings 412 and 413 of the buckling component 40, After it passes around the pin 327 installed within the body 30, and then enters into the buckling component. The buckling ring 411 and buckling portion 422 of the upper cover and lower cover 41 and 42 are connected with one another so that the two pillars 414 and 421 are fixed with respect to the conductive belt 50. Thus, the distal end of the conductive belt 50 is hidden within the buckling component. Therefore, the distal end of the conductive belt is not fixed by seaming and the length of the belt can be adjusted by adjusting the position of the buckling component with respect to the conductive belt 50.

Another end of the conductive belt 50 can be positioned within the concave portion 312 of the body 30, and then pressing the pressing plate 314 downwards, then the clamping strip 316 will press the upper portion of the embedding piece 324 of the conductive belt 50 so as to be fixed. Thus, a complete electrostatic resistant hand ring is formed. As a consequence, the conductive belt 50 will contact with the conductive belt 32, while the conductive plate 32 is connected to the convex button 323 by a rivet 322, and the conductive belt 50 with the convex button 323 are therefore formed as an electric loop. When the electrostatic resistant hand ring covers a wrist belt, the static electricity will be transferred to the ground through the conductive plate 32, conductive belt 50, rivet 322, convex button 323 and the wires connected to the convex button.

Since the two ends of the conductive belt 50 is fixed by the buckling component 40 and the pressing plate 314 so as to form a detachable structure. When the length of the conductive belt is not sufficient or updated, the original body 30 can be used. The distal end of the conductive belt 50 is hidden within the body 40 of the buckling component 40, thus the fiber will not separate so to disperse in air.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A structure of an electrostatic resistant hand ring, comprising:

a body formed by a cover and a conductive plate; wherein one side of the cover is installed with a concave portion which serves to be assembled with a pressing plate so as to press a first end of a conductive belt and fix the conductive belt;

the conductive plate, one side of which is bent with an angle of 180 degrees so as to form an embedding piece for being embedding to the concave portion, including two enclosing plates being formed on two sides of the conductive plate, wherein distal ends of the enclosing plates being formed with holes, respectively; and a buckling component formed by an upper cover and a lower cover, one lateral side of the upper cover being connected to the lower cover, and an opposite side being formed with a buckling ring, while two lateral sides thereof being installed with a first hanging ring and a second hanging ring, a pillar being formed on a proper position within the upper cover; while another pillar being formed on a proper position within the lower cover, and a buckling portion is installed on the lower cover in a place with respect to the buckling ring;

wherein by the buckling component fixing a second end of the conductive belt, the length of the conductive belt is adjustable as desired by adjusting the position of the buckling component.

2. The structure of the electrostatic resistant hand ring as claimed in claim 1, wherein the cover is installed with hole with respect to the conductive belt, thereby, a rivet passes through from the lower portion of the conductive plate to a convex button above the cover, as a consequence, the belt and the conductive plate are combined together.

3. The structure of the electrostatic resistant hand ring as claimed in claim 1, wherein one side of the concave portion is installed with respective axial hole and a thin edge is installed below the axial hole.

4. The structure of the electrostatic resistant hand ring as claimed in claim 3, wherein two sides of the pressing plate are installed with projected axial rods and a clamping strip is installed therebelow; the axial rod is assembled within the axial hole of the concave portion, thereby, the pressing plate can be opened upwards by being screwed.

5. The structure of the electrostatic resistant hand ring as claimed in claim 3, wherein the embedding piece is embedded into the thin edge on the concave portion.

6. The structure of the electrostatic resistant hand ring as claimed in claim 1, wherein two sides of the pressing plate are installed with projected axial rods and a clamping strip is installed therebelow; the axial rod is assembled within the axial hole of the concave portion, thereby, the pressing plate can be opened upwards by being screwed.

7. The structure of the electrostatic resistant hand ring as claimed in claim 1, wherein the embedding piece is embedded into the thin edge on the concave portion.

8. The structure of the electrostatic resistant hand ring as claimed in claim 1, wherein the pillars of the upper cover and the lower cover of the buckling component, respectively, are aligned with one another.

* * * * *